US006327807B1

(12) United States Patent
Bergacker

(10) Patent No.: US 6,327,807 B1
(45) Date of Patent: Dec. 11, 2001

(54) FIREARM SIGHT MOUNT

(76) Inventor: John W. Bergacker, 1009 NE. 104 St., Miami Shores, FL (US) 33138

( * ) Notice: Subject to any disclaimer, the term of this patent is extended or adjusted under 35 U.S.C. 154(b) by 0 days.

(21) Appl. No.: 09/482,339

(22) Filed: Jan. 14, 2000

(51) Int. Cl.[7] ..... F41G 1/38
(52) U.S. Cl. ..... 42/124
(58) Field of Search ..... 42/100, 99, 124, 42/86

(56) References Cited

U.S. PATENT DOCUMENTS

| | | | | |
|---|---|---|---|---|
| 2,874,504 | * | 2/1959 | Martinek | 42/76.01 |
| 3,877,166 | * | 4/1975 | Ward | 42/100 |
| 4,328,624 | * | 5/1982 | Ross | 33/245 |
| 4,941,277 | * | 7/1990 | Lawlor | 42/100 |
| 5,481,818 | * | 1/1996 | Stover | 42/100 |
| 5,490,654 | * | 2/1996 | Herriman | 248/316.1 |
| 5,669,173 | * | 9/1997 | Rodney, Jr. | 42/101 |
| 5,724,761 | * | 3/1998 | Bergacker | 42/100 |
| 5,918,374 | * | 7/1999 | Campbell et al. | 33/233 |
| 6,058,615 | * | 5/2000 | Uhlmann et al. | 33/241 |

* cited by examiner

*Primary Examiner*—Charles T. Jordan
*Assistant Examiner*—John W. Zerr
(74) *Attorney, Agent, or Firm*—Michael W. York

(57) ABSTRACT

A firearm sight mount with a sight mount body configured for clamping on the outside of a firearm barrel. In one embodiment the sight mount has a unitary sight mount body that is split to permit the body to be slipped past any existing front sight on the firearm barrel. The split construction of the sight mount body permits it to be clamped to firearm barrels having different outside diameters and tapers. The other embodiments use a two piece body that are configured to be clamped to firearm barrels having different outside diameters and tapers and in one of these embodiments provision is made for the sight mount to fit around a rib on the barrel. In all embodiments, the sight mount body has a flat rectangular shaped mounting surface with short cylindrical projections sized and shaped to mesh with corresponding holes in the sight and hold the sight in place. Two screw holes are also provided in the mounting surface for holding the sight to the mounting surface. The use of only two screws reduces the number of screws that can work loose when the firearm is fired.

10 Claims, 2 Drawing Sheets

12
136
132
140
117
144
72
138
134
84

128
80
117
112
126
112
130
112
112
117

12
126
92
82
94
117
84
88
72
90
80

132
136
134
112
150
124
146
84
117
R
R
D'
108
H2
148
124

82
80
118b
112
98
120b
124
102
108
84
117
R
R
D'
116
86
118a
112
96
120a
100
124

FIREARM SIGHT MOUNT

BACKGROUND OF THE INVENTION

Telescopes and similar sights have come into widespread use on firearms. These sights are used on many different types of firearms, such as rifles or shotguns and pistols and revolvers. These types of sights are typically secured to the receiver or breech end of the firearm and possibly also the barrel using a mounting assembly or system that usually has threaded screws or bolts. Proper accuracy with such sights requires that the the mounting system remain completely rigid. Unfortunately, when the firearm is fired the recoil tends to loosen the screws and/or bolts that are used to secure the sight to the firearm. This makes it impossible to shoot the firearm accurately since the sight will not remain in one fixed position with respect to the firearm.

Another problem associated with the loosening of the screws associated with prior art sight mounts is the possibility that such screws can bend or actually shear so that the sight and the sight mount become totally useless. In addition, the bolt or screw holes can also become distorted and enlarged. Under appropriate circumstances when the sight mount screws or bolts become loose tremendous lever or torque forces can be exerted upon these loose screws or bolts. This is possible since these screws or bolts in many instances have a long length and a force exerted on the end of such a long screw or bolt is equivalent to exerting a force on a long lever arm. consequently, a large torque is exerted upon the screw or bolt that can easily bend or sheer the screw or bolt.

A further problem associated with mounts for telescopic and similar type sights is that these mounts are different for each specific firearm. Consequently, it is not possible to use the same mount for different type firearms or to switch a mount from one type firearm to another. In addition, with prior art mounting systems it is necessary for a distributor or a retailer to maintain a wide variety of numerous sight mount components for a wide variety of firearms in order to satisfy their customers. This is both expensive and time consuming.

The firearm sight mount of this invention overcomes these problems associated with prior art telescopic and similar sight mounts. This firearm sight mount uses a minimum of screws or bolts and replaces many of the screws with tight fitting short studs that cannot work loose and are not susceptible to damage by high torque forces. The nature of the construction of the firearm sight mount permits it to be secured to the barrel of an unaltered firearm, and it is possible to use this firearm sight mount on a variety of different types of firearms that have basically similar outer barrel dimensions.

SUMMARY OF THE INVENTION

This invention relates to firearm sights and mounts for small arms and more particularly to a firearm sight mount for the barrel of a firearm.

It is an object of the invention to provide a firearm sight mount that is easy to use on a variety of firearms.

It is an object of the invention to provide a firearm sight mount that is easy to mount on a firearm barrel that has an existing front sight without removing the existing front sight.

It is an object of the invention to provide a firearm sight mount that is easy to mount on a firearm barrel that has an existing front sight without altering the existing front sight.

It is an object of the invention to provide a firearm sight mount that is easy to remove from the firearm.

It is an object of the invention to provide a firearm sight mount that does not require modification of the firearm for installation.

It is an object of the invention to provide a firearm sight mount that does not damage or mar the finish of the firearm on which it is installed.

It is an object of the invention to provide a firearm sight mount that does not unbalance the firearm.

It is an object of the invention to provide a firearm sight mount that is made from a light weight material.

It is an object of the invention to provide a firearm sight mount that is made from plastic.

It is an object of the invention to provide a firearm sight mount that is very rugged.

It is an object of the invention to provide a firearm sight mount that is easy to manufacture.

It is an object of the invention to provide a firearm sight mount that is inexpensive to manufacture.

It is an object of the invention to provide a firearm sight mount that is manufactured by molding a plastic material.

These and other objects of the firearm firearm sight mount will become apparent from the following described firearm sight mount invention that includes a sight mount body, connecting means on the sight mount body for connecting the firearm sight mount to a firearm barrel and means on the sight mount body for mounting a sight to the sight mount body. The firearm sight mount is either split or formed in two sections to enable the sight mount to be mounted on a barrel that has a sight and possibly a sight rib.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figure 1:
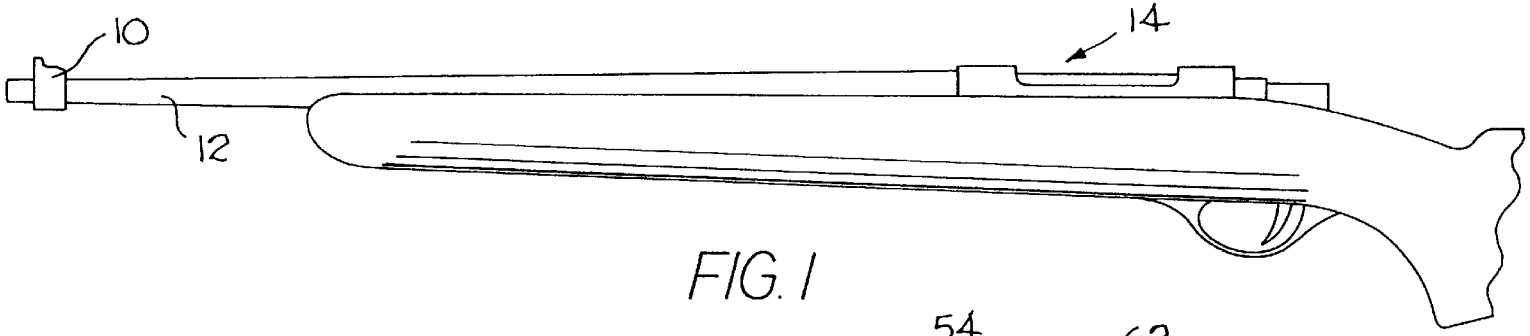
FIG. 1 is a side elevational view of a rifle illustrating one embodiment of the firearm sight mount invention and a sight attached to the muzzle end portion of the firearm barrel.

Referring first to FIG. 1, one embodiment of the firearm sight mount is illustrated and is designated generally by the number 10. As illustrated, the firearm sight mount 10 is shown attached or mounted on the muzzle end barrel portion 12 of a firearm 14. The fact that the firearm sight mount 10 is configured to be mounted on the muzzle end barrel portion 12 of the firearm 14 permits it to be used on a variety of firearms since most firearms have their muzzle end barrel portions relatively free of any obstructions such as stocks, bolts and other mechanisms or the like that would interfere with the attachment of the firearm sight mount 10 to the firearm.

The firearm sight mount 10 comprises a unitary sight mount body 16 that is made from a plastic material that is strong but will bend or yield to some degree. This sight mount body 16 has a centrally located generally circular cross section shaped aperture 18 that extends through it from its forward surface 20 to its rearward surface 22 along the long central axis A of the sight mount body 16. The sight mount body 16 has a split 24 in it that extends from the surface of the hole 18 outward to the lower surface 26 of the sight mount body 16. This split 24 permits the right and left portions 28 and 30 that are located around the hole 18 to be spread apart slightly and indicated by the arrows B and the dashed lines for the spread apart portions 28 and 30. This permits the hole 18 to change its size and shape to accommodate gun barrels with different outer dimensions including barrels with different exterior tapers.

Two elongated flanges 32 and 34 are located on each side of the split 24. These flanges 32 and 34 each have three holes such as the holes 36 and 38 in them through which threaded screws 40 pass that are threaded into nuts such as the nut 42. These screws 40 and nuts 42 can be tightened to clamp the flanges 32 and 34 together which results in the hole 18 being made smaller so that the sight mount 10 is clamped securely to the firearm muzzle end portion 12.

Figure 3:
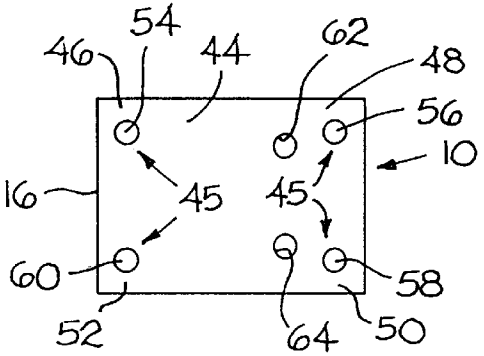
FIG. 3 is a top plan view of the firearm sight mount set forth in FIG. 2.
Figure 2:
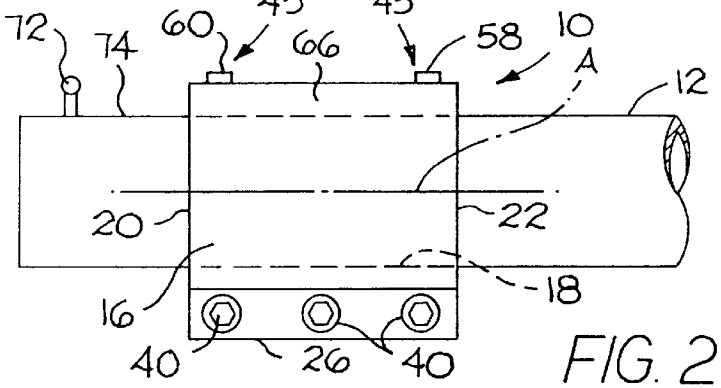
FIG. 2 is a side elevational view of the firearm sight mount invention attached to the muzzle end portion of the barrel of the firearm set forth in FIG. 1.

The upper surface 44 of the sight mount body 16 is substantially flat and is rectangular shaped, when viewed from above such as in FIG. 3, with four corners 46, 48, 50 and 52 and with a projecting stud pattern portion 45 with four identical circular cross section cylindrical short projections or studs 54, 56, 58 and 60 extending upward at 90 degrees from the flat surface 44. It is important that the height H of these projections 54, 56, 58 and 60 not be greater than one-half of the diameter D of these projections 54, 56, 58 and 60 that have equal diameters. This relationship is set forth below:

$$H=D/2$$

where: H is the maximum height of the projection 54, 56, 58 or 60

D is the diameter of the projection 54, 56, 58 or 60. This relationship is necessary in order to ensure that the projections 54, 56, 58 or 60 are not subjected to forces upon firing that would result in excessive torque or other forces that would damage or distort these projections 54, 56, 58 or 60. Such damage or distortion of the projection 54, 56, 58 or 60 would lead to the attached sight becoming loose and hence would prevent accurate shooting.

The upper surface 44 also has two identical circular threaded holes 62 and 64 in it and these holes 62 and 64 extend partially through the upper portion 66 of the sight mount body 16. These holes 62 and 64 are used to accept screws (not shown) to attach a scope to the upper surface 44 of the upper portion 66 of the sight mount body. The projections 54, 56, 58 and 60 are located to mate with and be inserted into corresponding holes in the sight (not shown) or a sight adapter (not shown). The projections 54, 56, 58 and 60 are adapted to absorb most of the recoil upon firing rather than the screws that would be inserted into the holes 62 and 64.

Figure 4:
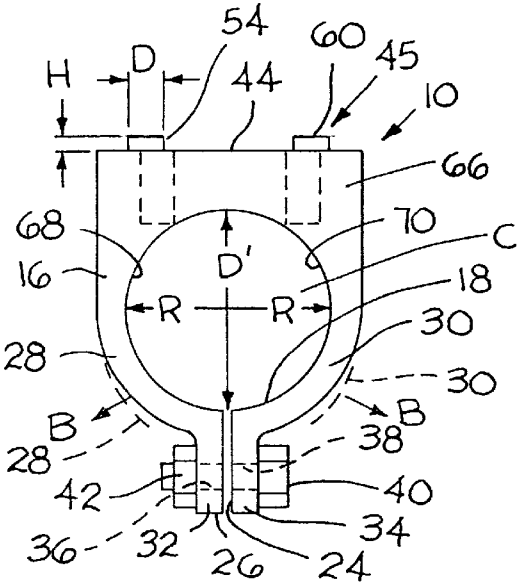
FIG. 4 is an enlarged end elevational view of the firearm sight mount invention set forth in FIG. 3 with the firearm sight mount invention not attached to the muzzle end portion of the barrel of a firearm.

As illustrated in FIG. 4, although the aperture 18 in the sight mount body 16 has a generally circular cross section, it is deliberately not circular. Instead, a vertical slice has been taken out of a circle to form this cross section that is designated by the letter C. Consequently, the two opposite surfaces 68 and 70 are identical and form a portion of half of a circle with a radius R. However, the distance D', that would be the diameter of the circle if the cross section C was a circle, is greater than the diameter that would equal twice the radius R. The relationship is set forth below:

$$D'=A+2\times R$$

where: $0.05<A<0.10$,

D' is the distance across the aperture 18 from its top to its bottom,

R is the of the radius of the circle whose circumference matches the curved surface 68 or 70.

It has been determined that this relationship results in the best gripping surfaces 68 and 70 when the sight mount body 16 is clamped to the outer surface of the firearm barrel muzzle portion 12.

Figures 5, 6, 7, 8, 9:
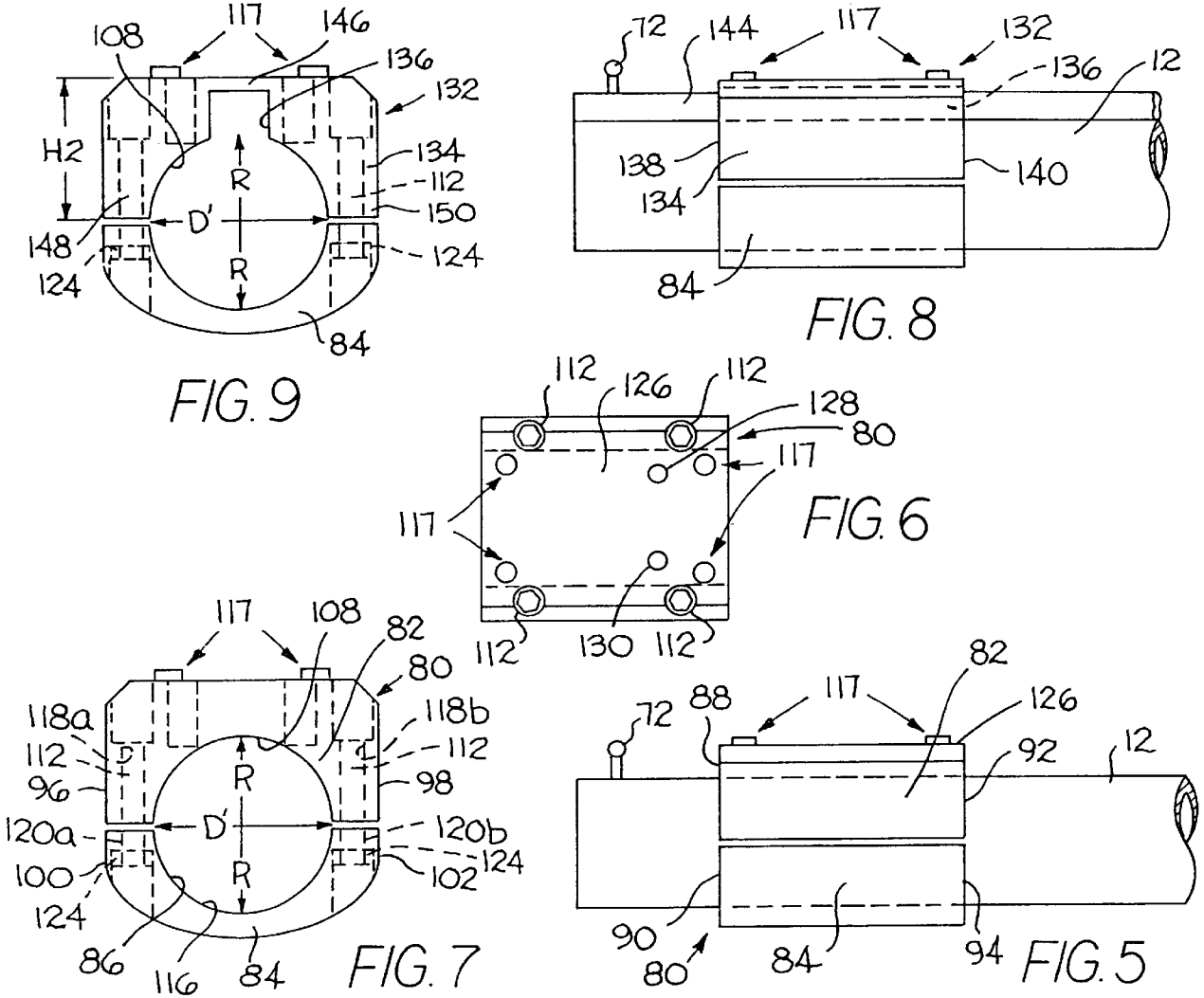
FIG. 5 is a side elevational view of a second embodiment the firearm sight mount invention attached to the muzzle end portion of the barrel of a firearm such as that set forth in FIG. 1.
FIG. 6 is a top plan view of the firearm sight mount set forth in FIG. 5.
FIG. 7 is an enlarged end elevational view of the firearm sight mount invention set forth in FIG. 6 with the firearm sight mount invention not attached to the muzzle end portion of the barrel of a firearm.
FIG. 8 is a side elevational view of a third embodiment the firearm sight mount invention attached to the muzzle end portion of the barrel of a firearm such as that set forth in FIG. 1.
FIG. 9 is an enlarged end elevational view of the firearm sight mount invention set forth in FIG. 8 with the firearm sight mount invention not attached to the muzzle end portion of the barrel of a firearm.

The second firearm sight mount embodiment is illustrated in FIGS. 5 through 7 and is designated by the number 80 and comprises an upper sight mount body 82 and a lower sight mount body 84 that are made from the same material as the sight mount body 16 that is strong but will bend or yield to some degree. The upper and lower sight mount bodies 82 and 84 are formed so that when they are secured together they form a centrally located generally circular cross section shaped aperture 86 that extends through the upper and lower sight mount bodies 82 and 84 from the forward surfaces 88 and 90 to the rearward surface 92 and 94 of the respective sight mount bodies 82 and 84. The fact that the aperture 86 is formed by the two separate sight mount bodies 82 and 84 permits the right and left portions 96 and 98 of the upper sight mount body 82 to be spread apart slightly from the respective right and left portions 100 and 102 of the lower sight mount body 84 that are located around the hole 86 when the upper and lower sight mount bodies 82 and 84 are located at the desired location on the muzzle end barrel portion 12. This permits the hole 86 to change its size and shape to accommodate muzzle end gun barrel portions 12 with different outer dimensions including barrels with different exterior tapers.

The two connecting side portions 96 and 98 are located on the upper sight mount body 82 adjacent the upper half circular curved surface 108 that forms part of the circular cross section aperture 86. In a similar manner, the lower sight mount body 84 has the two elongated connecting side portions 100 and 102 located adjacent the lower half circular surface 116 that also forms part of the circular cross section aperture 86. These connecting side portions 96 and 98 and 100 and 102 each have two respective identical holes 118*a*, 118*b*, and 120*a*, 120*b*, in them through which threaded screws 112 pass that are threaded into nuts such as the nuts 124. These screws 112 and nuts 124 can be tightened to clamp the respective connecting side portions 96 and 98 and 100 and 102 together which results in the hole 86 being made smaller so that the sight mount 80 is clamped securely to the firearm muzzle end barrel portion 12.

AS illustrated in FIG. 6, the upper surface 126 of the upper sight mount body 82 has a projecting stud pattern portion 117 that is is identical to the projecting stud pattern portion 45 located on the upper surface 44 of the sight mount body 16 of the previous firearm sight mount 10. The upper surface 126 also has two identical circular threaded holes 128 and 130 that are similar to the threaded holes 62 and 64 of the previous embodiment 10 and these holes 128 and 130 extend partially through the upper sight mount body 82. These holes 128 and 130 are adapted to accept screws (not shown) to attach a scope to the upper surface 126 of the sight mount body 82.

As illustrated in FIG. 7, in a manner similar to that for the embodiment 10 and its aperture 18, the aperture 86 formed by the upper and lower sight mount bodies 82 and 84 has a generally circular cross section, but it is intentionally not circular. Instead, a horizontal slice has been taken out of a circle to form this cross section that is designated by the letter F. Consequently, the two opposite surfaces 108 and 116 that are identical to the surfaces 68 and 70 of the sight mount embodiment 10 and each form a circle with a radius R that has the same relationship between D' and A, namely $D'=A+2\times R$ of the first sight mount embodiment 10 as previously described and illustrated in FIG. 4.

The third firearm sight mount embodiment is illustrated in FIGS. 8 and 9 and is designated by the number 132 and is substantially identical to the previously described second embodiment 80, except for a minor modification to the upper sight mount body 82 of the previous embodiment 80. In this connection, the upper sight mount body of the third embodiment 132 that is designated 134 is formed with a generally rectangular shaped circular cross section slot 136 in it that extends upward through the upper curved surface 108 from the forward surface 138 to the rearward surface 140 of the of the upper sight mount body 134. This slot 136 is sized and shaped to receive the rib 144 that may be located on the top of the firearm forward barrel portion 12. It will be noted that the upper sight mount body 134 has a greater height H2 than the previous upper sight mount body 82 to accept the slot 136 and the web portion 146. The connecting side portions 148 and 150 of the sight mount body 134 are similar to the connecting side portions 96 and 98 of the upper sight mount body 82 except that they have a greater height.

The firearm sight mount 10 and the other firearm sight mount embodiments 80 and 132 are made in the following manner. The unitary sight mount body 16 of the embodiment 10 and the sight mount bodies 82 and 84 and 134 of the other embodiments are cast from glass filled urethane plastic available from Dow Plastics, Dow Center of Midland, Mich. 48674. This casting is done using conventional plastic molding equipment known in the art and the resulting sight mount base 16 and sight mount bodies 82 and 84 and 134 need little if any outer surface machining or polishing. The holes 36 and 38 in the respective flanges 32 and 34 are formed during the injection molding process as are the holes 62 and 63 and 128 and 130 and 118*a* and 118 *b* and 120*a* and 120*b*. The screws 40 and 112 and nuts 42 and 124 are conventional off the shelf items.

The firearm sight mount 10 is used in the following manner. The screws 40 and nuts 42 are removed and the sight mount body 16 is spread apart at the split 24 as indicated by the arrows B in FIG. 4. The sight mount body 16 is than mounted by slipping it onto the muzzle portion 12 of the firearm barrel with the flanges 32 and 34 passing on the sides of the sight 72 that is located on the upper side 74 of the firearm barrel muzzle portion 12. After the flanges 32 and 34 have gone beyond the sight 72 the sight mount body 16 is inverted to its normal position and the screws 40 and associated nuts 42 are tightened to clamp the flanges 32 and 34 together and hence clamp the sight mount body 16 to the outer surface of the firearm barrel muzzle portion 12.

The firearm sight mount 80 is used in the following manner. The screws 112 and nuts 124 are removed from the sight mount bodies 82 and 84. The sight mount bodies 82 and 84 are then mounted on the muzzle portion 12 of the firearm barrel with the connecting side portions 96 and 100 and 98 and 102 located opposite each other on the sides of the firearm barrel muzzle portion 12 at the desired location on the firearm barrel muzzle portion 12. The screws 112 are then inserted into the holes 118*a*, 118*b* and 120*a*, 120*b* and the associated nuts 124 are tightened to clamp the respective connecting side portions 96 and 100 and 98 and 102 together and hence clamp the sight mount bodies 82 and 84 of the firearm sight mount 80 to the outer surface of the firearm barrel muzzle portion 12.

The fact that the sight mount body 16 is made from plastic allows it to deform slightly and hence allows the aperture 18 to be deformed to fit a particular barrel muzzle portion 12 configuration. As previously indicated, the particular dimensions D' and R for the aperture 18 also provide excellent clamping of the surfaces 68 and 70 on the exterior surface of the firearm barrel muzzle portion 12. In addition since the sight mount body and its clamping surfaces 68 and 70 are plastic this prevents marring of the outer surface of the firearm barrel muzzle portion 12 by the clamping surfaces 68 and 70. The same advantages set forth above for the sight mount embodiment 10 also apply to the sight mount embodiments 80 and 132 and their plastic sight mount bodies 82 and 84 and 134 with their respective clamping surfaces 108 and 116.

Although the invention has been described in considerable detail with reference to certain preferred embodiments, it will be understood that variations or modifications may be made within the spirit and scope of the invention as defined in the appended claims.

What is claimed is:

1. A firearm sight mount for attachment to the outer surface of the muzzle end portion of the barrel of a firearm comprising a sight mount body, mounting means on said sight mount body for mounting a sight to said sight mount body comprising a substantially flat mounting surface having a pattern of a plurality of projecting identical circular cross section cylindrical studs with the studs having a maximum height H above said mounting surface determined as follows:

$$H=D/2$$

Where D is the diameter of said circular cross section cylindrical studs and attaching means on said sight mount body for attaching said firearm sight mount to the outer surface of the muzzle end portion of a firearm barrel.

2. The firearm sight mount for attachment to the outer surface of the muzzle end portion of the barrel of a firearm of claim 1 wherein said studs project at an angle of ninety degrees from said substantially flat mounting surface.

3. The firearm sight mount for attachment to the outer surface of the muzzle end portion of the barrel of a firearm of claim 2 wherein said substantially flat mounting surface is rectangular shaped.

4. The firearm sight mount for attachment to the outer surface of the muzzle end portion of the barrel of a firearm of claim 3 wherein said pattern of a plurality of projecting identical circular cross section cylindrical studs comprises four studs.

5. The firearm sight mount for attachment to the outer surface of the muzzle end portion of the barrel of a firearm of claim 2 wherein said firearm sight mount comprises a plastic material.

6. The firearm sight mount for attachment to the outer surface of the muzzle end portion of the barrel of a firearm of claim 5 wherein said plastic material comprises a glass filled urethane.

7. The firearm sight mount for attachment to the outer surface of the muzzle end portion of the barrel of a firearm of claim 6 wherein said attaching means on said sight mount body for attaching said firearm sight mount to the outer surface of the muzzle end portion of a firearm barrel comprises means for clamping said firearm sight mount to the outer surface of the muzzle end portion of the barrel of a firearm.

8. The firearm sight mount for attachment to the outer surface of the muzzle end portion of the barrel of a firearm of claim 7 wherein said clamping means for clamping said firearm sight mount to the outer surface of the muzzle end portion of the barrel of a firearm comprises means for enabling said firearm sight mount to be clamped to a firearm barrel having a sight on the muzzle portion thereof.

9. The firearm sight mount for attachment to the outer surface of the muzzle end portion of the barrel of a firearm of claim 7 wherein said clamping means for clamping said firearm sight mount to the outer surface of the muzzle end portion of the barrel of a firearm comprises means for enabling said firearm sight mount to be clamped to a firearm barrel having a sight rib.

10. The firearm sight mount for attachment to the outer surface of the muzzle end portion of the barrel of a firearm of claim 7 wherein said clamping means for clamping said firearm sight mount to the outer surface of the muzzle end portion of the barrel of a firearm comprises a non circular aperture for fitting around the outer surface of the muzzle end portion of the barrel of a firearm.

* * * * *